US010731679B2

(12) United States Patent
Unterdorfer

(10) Patent No.: US 10,731,679 B2
(45) Date of Patent: Aug. 4, 2020

(54) CONSUMER CONTROL DEVICE AND A CONTROL METHOD

(71) Applicant: Festo SE & Co. KG, Esslingen (DE)

(72) Inventor: Pascal Unterdorfer, Stuttgart (DE)

(73) Assignee: FESTO SE & Co. KG, Esslingen (DE)

( * ) Notice: Subject to any disclaimer, the term of this patent is extended or adjusted under 35 U.S.C. 154(b) by 0 days.

(21) Appl. No.: 16/271,224

(22) Filed: Feb. 8, 2019

(65) Prior Publication Data

US 2019/0257329 A1 Aug. 22, 2019

(30) Foreign Application Priority Data

Feb. 16, 2018 (DE) ..... 10 2018 202 416

(51) Int. Cl.
*F15B 21/04* (2019.01)
*F15B 21/048* (2019.01)
*F15B 19/00* (2006.01)

(52) U.S. Cl.
CPC ..... *F15B 21/048* (2013.01); *F15B 19/005* (2013.01); *F15B 2211/31529* (2013.01); *F15B 2211/31535* (2013.01); *F15B 2211/51* (2013.01)

(58) Field of Classification Search
CPC .. F15B 19/005; F15B 21/048; F15B 2211/51; F15B 2211/31535; F15B 2211/31529
See application file for complete search history.

(56) References Cited

U.S. PATENT DOCUMENTS 5,454,291 A * 10/1995 Ulm ..... B62D 7/159 91/445
6,516,706 B2 * 2/2003 Porter ..... F15B 1/265 91/420
6,769,250 B2 * 8/2004 Fuss ..... F15B 19/005 60/403
8,266,902 B2 * 9/2012 Nolle ..... F15B 13/086 60/406

FOREIGN PATENT DOCUMENTS

DE 202006002145 U1 4/2006
DE 102006007103 A1 9/2007
DE 102011012558 B3 7/2012
DE 102013015105 A1 * 3/2015
EP 2728205 A2 5/2014
EP 2865899 A1 4/2015

* cited by examiner

*Primary Examiner* — Abiy Teka
(74) *Attorney, Agent, or Firm* — Hoffmann & Baron, LLP

(57) ABSTRACT

A consumer control device, with which an external consumer device can be supplied with compressed air in a controlled manner, contains a compressed air maintenance unit, equipped with a proportional pressure regulating valve that can be electrically actuated, which is connectable via an outlet channel with the consumer device to be actuated. In the outlet channel an electrically controllable shut-off valve and an outlet pressure sensor are connected, both of which communicate with an internal electronic control unit, which is also supplied with information on the air flow in the outlet channel. The consumer control device can be operated according to a similarly proposed method, in that the consumer device in a normal operating phase is supplied with compressed air by the shut-off valve that is in the release position, which is regulated by a proportional pressure regulating valve adopting working mode at a working pressure value.

21 Claims, 2 Drawing Sheets

CONSUMER CONTROL DEVICE AND A CONTROL METHOD

BACKGROUND OF THE INVENTION

The invention relates to a consumer control device, with a compressed air maintenance unit having the following components:

an electrically controllable proportional pressure regulating valve, having a supply input and a service output, a device inlet, connectable or connected to an external compressed air source, connected via an inlet channel to the supply input of the proportional pressure regulating valve, a device outlet connectable or connected to an external consumer device, connected via an outlet channel to the service output of the proportional pressure regulating valve, sensor arrangement at least in the form of a flow sensor for measuring the air flow occurring in the inlet channel and/or outlet channel and an outlet pressure sensor for measuring the outlet pressure prevailing in the outlet channel, an internal electronic control unit connected via a signal path to the proportional pressure regulating valve and with the sensor arrangement, configured, to generate an electrical pressure regulating signal for the proportional pressure regulating valve, as a function of the state values of the compressed air measured by the sensor arrangement wherein the proportional pressure regulating valve can regulate the outlet pressure prevailing in the outlet channel at various levels as a function of the electrical pressure regulating signal applied to it, wherein it is operable both in a working mode regulating the outlet pressure to a working pressure value and a hold mode regulating the outlet pressure to a hold pressure that is lower than the working pressure value.

The invention further relates to a method for controlling the compressed air supply of a consumer device by means of a consumer control device, in particular with a configuration corresponding to the type mentioned above.

A prior art configured and usable in the abovementioned way is known from EP 2 865 899 A1. Here it is a case of a consumer control device, having a compressed air maintenance unit, to the device output of which a consumer device to be supplied with compressed air can be connected. The compressed air maintenance unit unit is equipped with a proportional pressure regulating valve, which by means of an internal electronic control unit is variably controllable with an electrical pressure control signal, in order to provide on the output side a regulated outlet pressure. A flow sensor measures the air flow to the connected consumer device, while an outlet pressure sensor also present measures the outlet pressure of the compressed air supplied to the consumer device. In the known device the proportional pressure regulating valve is operated, as a function of the flow, either in a working mode or in a hold mode referred to as standby mode. In working mode, the connected consumer device is supplied with compressed air, wherein the level of the outlet pressure corresponds to a working pressure value necessary for correct operation of the connected consumer device. If the air flow drops below a specified shutdown flow threshold, the proportional pressure regulating valve is placed in hold mode, in which the outlet pressure is lowered to a reduced hold pressure value, resulting in an energy saving.

From EP 2 728 205 A2 a consumer control device is similarly known, but in this case instead of a proportional pressure regulating valve a shut-off valve configured as a 2/2-way valve is present. In a normal operational phase of the consumer control device the shut-off valve adopts a release position allowing an unimpeded passage of air. If under certain circumstances it is intended to avoid air consumption in the downstream external consumer device or in the in channel system leading to this consumer device, the shut-off valve can be switched to a shut-off position preventing a passage of air. This may in particular be the case if the connected consumer device is not operated for a long period.

In a consumer control device known from DE 10 2011 012 558 B3, instead of a proportional pressure regulating valve or a 2/2-shut-off valve, a 3/3-way valve is present, with the help of which a connected consumer device cannot just be isolated from an external compressed air source, but if necessary a consumer-side venting can be carried out.

DE 10 2006 007 103 A1 discloses a modular compressed air maintenance unit which has a plurality of unit modules which are arranged one after another in a row direction and are connected releasably to one another. At least two unit modules are fastened releasably to one another by a module connector which is placed between them, wherein the module connector has a through opening, via which the two unit modules are connected fluidically to one another. The module connector is equipped with at least one sensor device which is connected to the through opening and makes it possible to monitor state values of the flowing compressed air.

DE 20 2006 002 145 U1 describes a compressed air maintenance unit comprising a compressed air inlet and a compressed-air outlet, which has a plurality of adjacent modules which are connected to one another by fastening means. The module arrangement comprises a pressure booster device which is capable of raising the pressure of the supplied compressed air to a higher working pressure.

SUMMARY OF THE INVENTION

The object of the invention is to adopt measures which allow an energy-efficient and at the same time trouble-free use of a consumer device operated by compressed air.

The object is achieved by a consumer control device of the abovementioned type in that, in the outlet channel between the proportional pressure regulating valve and the outlet pressure sensor an electrically controllable shut-off valve connected via a signal path to the internal electronic control unit, is connected, which through an electrical valve control signal from the internal electronic control unit can selectively be switched to a release position opening the outlet channel for an air flow or a shutoff position shutting off the outlet channel, wherein the internal electronic control unit is configured such that during the working mode of the proportional pressure regulating valve it can automatically switch over the shut-off valve from the release position to the shut-off position, if the flow sensor within a specified or specifiable time limit detects an air flow corresponding to or below a specified or specifiable shutdown flow threshold value, and wherein the internal electronic control unit is also configured such that it also automatically can switch the shut-off valve from the shut-off position back into the release position and place the proportional pressure regulating valve into the hold mode, if the outlet pressure sensor whilst the shut-off valve is in the shut-off position detects an outlet pressure that is lower than the working pressure and corresponds to a specified or specifiable threshold pressure value.

The object is also achieved by a method of the abovementioned type for controlling the compressed air supply of a consumer device by means of a consumer control device, in that the following method steps are performed:

the consumer device is supplied by an electrically controllable proportional pressure regulating valve and electrically controllable shut-off valve connected downstream and in series thereto with compressed air under outlet pressure, the air flow flowing through the proportional pressure regulating valve and the shut-off valve to the consumer device is measured, downstream of the shut-off valve an outlet pressure of the compressed air being supplied to the consumer device is also measured, during a normal operating phase of the consumer control device, in which the measured air flow is above a specified shutdown flow threshold, the proportional pressure regulating valve is operated in a working mode and the shut-off valve in a release position enabling the passage of air passage of air to the consumer device, wherein the proportional pressure regulating valve during the working mode outputs compressed air to the shut-off valve regulated at a specified working pressure value, during the normal operating phase, the shut-off valve is switched from the release position to a shut-off position preventing a passage of air, if the measured air flow within a specified time limit is not higher than a specified shutdown flow threshold, as a result of which from then on the consumer control device is operated in a stand-by mode phase, during the stand-by mode phase the shut-off valve is switched back to the release position and the proportional pressure regulating valve operated in a hold mode, if the measured outlet pressure during the shut-off position of the shut-off valve drops to a specified threshold pressure value, which is lower than the working pressure value, wherein the proportional pressure regulating valve during the hold mode outputs compressed air to the shut-off valve at a regulated hold pressure value that is lower than the working pressure value.

The consumer control device according to the invention contains a compressed air maintenance unit, having an electrically controllable proportional pressure regulating valve, with which the pressure referred to as outlet pressure of compressed air to be supplied to a connected external consumer device can be provided in a regulated manner. The compressed air maintenance unit has an internal electronic control unit, which can supply the proportional pressure regulating valve with a pressure regulating signal corresponding to the desired outlet pressure. In this way, the proportional pressure regulating valve can be placed either in a working mode or a hold mode, wherein the outlet pressure made available in the working mode has a working pressure value and in the hold mode a hold pressure value that is lower than the working pressure value. Downstream of the proportional pressure regulating valve, an electrically operable shut-off valve is connected which is similarly operable by the internal electronic control unit, in that it is supplied with a corresponding electrical valve control signal. The shut-off valve can release an outlet channel connecting on the output side to the proportional pressure regulating valve as a function of position for a passage of air or shut this off to prevent a passage of air. The corresponding switching positions are referred to as release position and shut-off position. If the shut-off valve is in the shut-off position, a fluid channel running between this and the connected consumer device is isolated from the proportional pressure regulating valve and air volume present in the fluid channel is confined. Therefore, when the shut-off valve is in the shut-off position the current operating mode of the proportional pressure regulating valve has no influence on the air supply to the consumer device.

The consumer control device can be operated in a normal operating phase, in which the proportional pressure regulating valve adopts the working mode and the shut-off valve the release position. Then the connected consumer device is continuously supplied with compressed air, the outlet pressure of which corresponds to the working pressure value, which is, by way of example, 6 bar. If for a certain time, referred to as the time limit, the air requirement of the connected consumer device is at or below a specified or specifiable threshold, referred to as the shutdown flow threshold, then the shut-off valve is switched by the internal electronic control unit to the shut-off position. The reduced air requirement is as a rule an indication that the consumer device has come to a standstill, so that at least temporarily no more compressed air is needed. Switching to the shut-off position, in this connection, prevents as before, compressed air of below a relatively high working pressure being fed into the fluid line leading to the consumer device. The Consumer control device is now in a stand-by mode phase.

A particularity of the device and the method is that the outlet pressure applied to the consumer device cannot drop completely to atmospheric pressure during the stand-by mode phase. An outlet pressure sensor downstream of the shut-off valve measuring the outlet pressure provides the internal electronic control unit with the current pressure values of the outlet pressure, so that the internal electronic control unit can switch the shut-off valve back to the release position, if the outlet pressure has dropped to a specified or specifiable as required threshold pressure value. At this point at the latest the internal electronic control unit switches the operating mode of the proportional pressure regulating valve from the working mode to the hold mode. The mode change of the proportional pressure regulating valve to the hold mode preferably takes place simultaneously with the switching of the shut-off valve to the release position again. So, the outlet pressure applied to the external consumer device is now kept constant at the reduced hold pressure value which, by way of example, is 3 bar. The associated energy expenditure is substantially less than if the high working pressure value is constantly maintained. At the same time the consumer device is supplied with a minimum pressure at above atmospheric pressure, preventing malfunctions and if necessary favouring a rapid bringing back into service of the paused consumer device. The hold pressure value can preferably be set in a variable manner by the user of the consumer control device variable, allowing the best possible adaption to the connected consumer device. Expediently, the same also applies to the shut-off pressure flow threshold.

The hold threshold value may deviate from the threshold pressure value produced by the switching of the shut-off valve. It can, by way of example, be slightly higher. However, the hold pressure value and the threshold pressure value are preferably the same.

In the present description and in the claims, the term "flow" by way of simplification in place of the actual correct terms such as "volume flow", "flow rate" or "throughput rate" and signifies a flow quantity per unit of time.

Advantageous further developments of the invention are indicated by the dependent claims.

The shut-off valve is preferably a 2/2-way valve. It is expediently of the "normally open" type and preloaded by a spring in the release position. In particular, it only has to have an electrical valve control signal applied to switch and maintain the shut-off position. This ensures that the air supply to the consumer device is not interrupted even if the electrical valve control signal is lost due to a fault.

The internal electronic control unit is preferably configured in such a way that if there is an increase in air demand on the connected external consumer device side it can place the proportional pressure regulating valve that is currently in the hold mode in working mode while leaving the working valve in the release position. In this way, the consumer control device can if necessary be briefly switched from stand-by mode phase to normal operating phase. This switching process can be carried out automatically with a suitably equipped consumer control device. The air flow measured by the flow sensor can be used as a basis for this. This rises as the air demand from the consumer device increases, wherein the switching to the normal operating phase is commanded by the internal electronic control unit, if the measured flow has risen to a switch-on flow threshold. Alternatively, or additionally, the consumer control device can also be configured such that the switching to the normal operating phase can be brought about by an external electrical signal, by way of example by an external electronic control unit that controls the operating process of the external consumer device, by sensor technology associated with the external consumer device and connected to the internal electronic control unit and/or by a simple hand control.

The outlet pressure sensor is preferably configured separately from the proportional pressure regulating valve. But alternatively it can by all means be integrated into the proportional pressure regulating valve.

It is an advantage if the compressed air maintenance unit is equipped with a pressure sensor referred to as an inlet pressure sensor, connected to an inlet channel attached to the input of the proportional pressure regulating valve and which measures the inlet pressure prevailing therein. In this way, by way of example, a constant monitoring is possible of whether the desired system pressure is being applied at the correct level to the inlet side. Like the other sensor arrangement, the inlet pressure sensor is connected to the internal electronic control unit via a signal path.

It is worth mentioning at this point that the flow sensor measuring the air flow to the external consumer device is preferably connected to the abovementioned inlet channel, but in general can also be positioned at another point and in particular alternatively can be connected to the outlet channel.

The internal electronic control unit is expediently not just able to generate as necessary the pressure regulating signal and the valve control signal, but is in particular designed so that it can also output at least one electrical diagnostic signal, which can be generated with the assistance of the sensor arrangement, that is to say on the basis of the measured values captured by the sensor arrangement.

By way of example, a diagnostic signal can be output if compressed air states are determined by the flow sensor and/or a pressure sensor of the compressed air maintenance unit, which deviate from those expected or tolerable during normal operation. Deviating operating states can, by way of example, be due to leakage or malfunctions of components of the connected external consumer device.

The compressed air maintenance unit can be equipped directly with at least one optical display and/or with an acoustic alerter, operable on the basis of an electrical diagnostic signal generated by an output device of the internal electronic control unit, in order to indicate in situ problematic operating states.

The internal electronic control unit expediently has a comparator, in which actual information supplied by the sensor arrangement can be compared with reference information stored in memory means of the internal electronic control unit, wherein the internal electronic control unit also has at least one output device, configured so that, as a function of the comparison result of the comparator, they output the electrical pressure regulating signal for the proportional pressure regulating valve and the electrical valve control signal for the shut-off valve.

The internal electronic control unit is in particular equipped with memory means, in which data of various kinds, in particular measurement, control, diagnostics and/or analysis data, can be stored in a volatile manner and/or a remanent manner, that is to say permanently even in the event of a power failure.

The compressed air maintenance unit is preferably configured as a unit with a modular composition. The functional components of the device are expediently composed of modules, which can be assembled in various compositions according to the desired level of equipment.

The proportional pressure regulating valve is expediently a component of a first valve module, while the shut-off valve is a component of a second valve module. The outlet pressure sensor is preferably a component of a sensor module and the internal electronic control unit is preferably a component of a control module. Expediently, the compressed air maintenance unit also has at least one independent communication module, equipped with at least one communication interface connected to the internal electronic control unit. This also allows, in particular, at least one further compressed air maintenance unit or other fluid power devices to be interconnected with the compressed air maintenance unit of the consumer control device.

The compressed air maintenance unit is preferably equipped with one or more communication interfaces, to which an external electronic control unit and/or an electronic information readout device and/or an electronic information input device and/or at least one further piece of external electronic functioning as a higher-order control unit can be connected.

At least one communication interface expediently serves to integrate the compressed air maintenance unit into a modular, internally electrically interconnected system with local bus system.

By way of example, at least one communication interface is present, configured as a bus interface for in particular a serial data transfer. Such a bus interface allows the internal electronic control unit to be interconnected with other electronic devices via a field bus.

At least one communication interface is expediently designed as a digital or analogue input or as a digital or analogue output.

Communication with external devices takes place in particular in a wired manner, but can also be performed wirelessly via suitably designed communication interfaces. Any bus standard can be implemented for bus communication.

At least one communication interface is expediently suitable for bidirectional signal transmission. Apart from this, at least one communication interface is expediently configured for input and/or output of binary and/or analogue signals. Such a communication interface is expediently also present in addition to a communication interface configured as a bus interface.

To influence the operational behaviour of the internal electronic control unit and/or the sensor arrangement, the compressed air maintenance unit is expediently equipped with at least one suitable input device. Such at least one input device comprise, by way of example, at least one key and/or at least one switch. Additionally, or alternatively, input means can also be present, to allow a purely electrical data and/or signal input, by way of example via a special operating unit or via an external electronic control unit as a rule communicating with the compressed air maintenance unit. Such input means comprise in particular at least one electrical communication interface.

The equipment of the compressed air maintenance unit expediently allows extensive monitoring and diagnostics functions such as, by way of example, comparative measurements, thresholds monitoring and automatic and/or user-driven consumption measurements.

Expediently, the compressed air maintenance unit integrates functions for measured value compression and data reduction, and similarly functions for measured value analysis of for performing statistical functions.

Integration of the internal electronic control unit in the compressed air maintenance unit has the advantages that it allows autonomous operation of the compressed air maintenance unit, without relying on constant signal communication with interconnected devices or with an external electronic control unit, which substantially minimises the susceptibility to failure. Nevertheless, bus networking and/or connection with an external electronic control unit is obviously advantageous to allow coordination of the operating behaviour with other components of a system.

By selecting a suitable equipment specification, the compressed air maintenance unit can be designed as a field bus-capable system with an electrical interface for system parameterisation and for transmission of measurement and control data. Optional measures for local operation and visualisation, by way of example by an optional integrated display or via a locally-connectable display and operating unit, are similarly possible.

BRIEF DESCRIPTION OF THE DRAWINGS

In the following, the invention is described in more detail on the basis of the attached drawing. The drawing shows the following.

DETAILED DESCRIPTION

Figure 1:
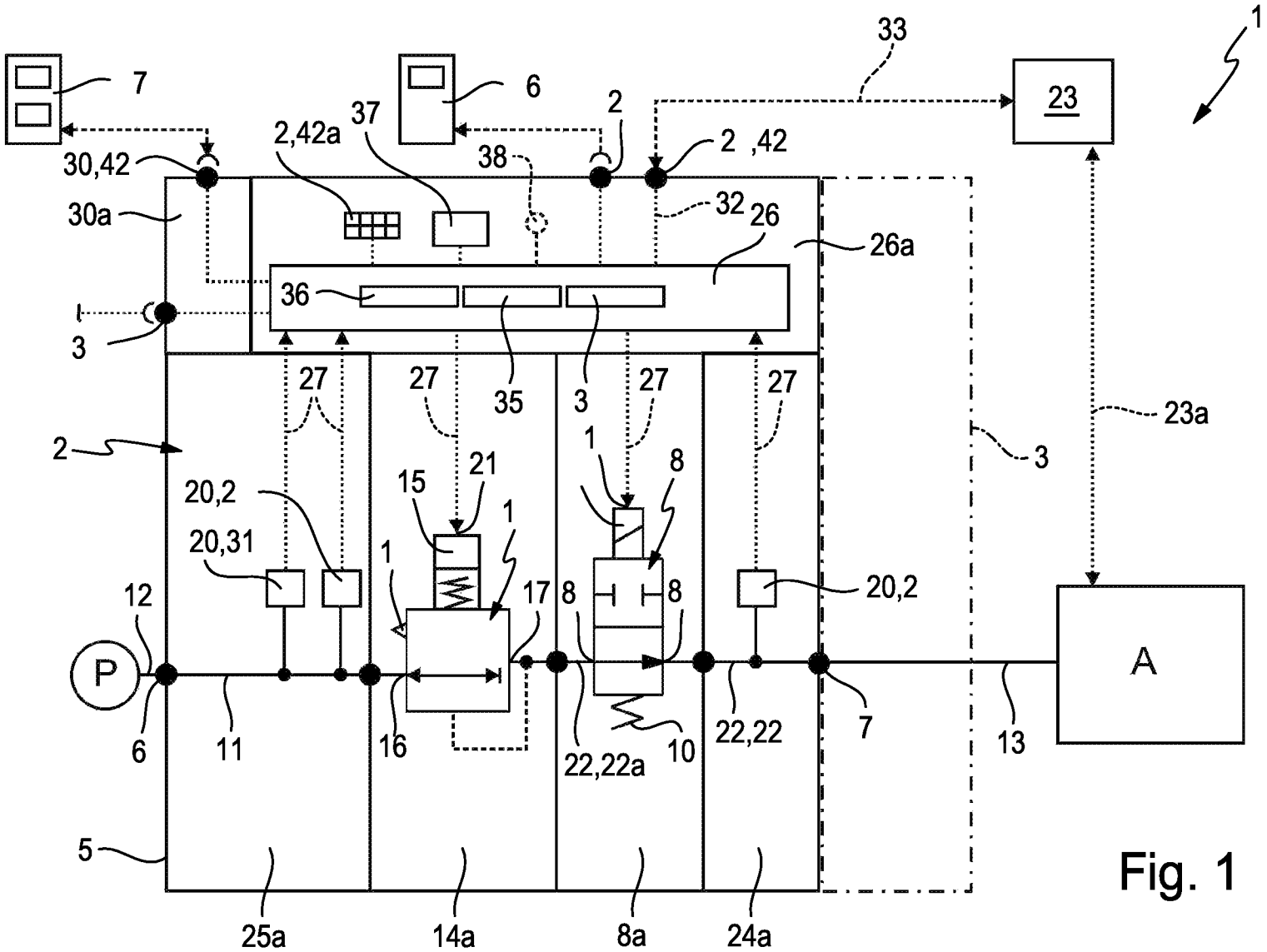
FIG. 1 a schematic representation of a preferred structure of the consumer control device according to the invention, and FIG. 2 a diagram to illustrate a preferred operating method of a consumer control device and in particular of the consumer control device shown in FIG. 1.

The consumer control device 1 contains as its main component at least one compressed air maintenance unit 2 preferably in the form of a self-supporting unit. The latter expediently has a modular structure. The compressed air maintenance unit 2 is preferably functionally expandable by attaching further maintenance modules, one of which is indicated in a dot-dash manner at 3. As at least one further maintenance module, by way of example a filter module and/or an air drying module can be present.

The compressed air maintenance unit 2 has a device housing 5, supporting and/or accommodating the other components of the compressed air maintenance unit 2. The device housing 5 expediently has a modular design.

On the outside of the device housing 5 a device inlet 6 and a device outlet 7 are located, each suitable for creating a fluid connection. The device inlet 5 is configured to be connected via a fluid line referred to as a supply line 12 to a compressed air source P. The state of such a compressed air source P connected to the device inlet 6 is illustrated.

The device outlet 7 is configured to be able to connect to a fluid line referred to as a working line 13 leading to an external consumer device A. A state, in which a consumer device A—by way of example a machine having a plurality of fluid-powered working components, for example fluid-powered drives—is connected to the device outlet 7 is shown.

The compressed air maintenance unit 2 has an electrically controllable proportional pressure regulating valve 14. This proportional pressure regulating valve 14 is expediently accommodated inside the device housing 5 and is preferably a component of a first valve module 14*a* of the modular compressed air maintenance unit 2.

The proportional pressure control valve 14 has a supply unit 16 serving for entry of air to be pressure regulated and a service output 17 serving for output of compressed air regulated at a specified pressure level. It also expediently also has a venting outlet 18 communicating with the atmosphere.

The compressed air maintenance unit has an electrical control input 21, to which an electrical pressure regulating signal can be applied, which specifies the set point for a regulator output pressure that can be picked up at the service output 17.

The proportional pressure regulating valve 14 expediently contains a control unit 15, in which an output thrust based on the regulator output pressure is compared with the variably-specifiable actuating power corresponding to the set point, wherein depending on the power ratio the service output 17 is connected to the supply input 16 or with the venting outlet 18. The actuating power results by way of example from a spring, the preloading of which can be varied electromotively or from an electromagnetically- or electrodynamically-generated force or from a fluid thrust. The proportional pressure regulating valve 14 can, by way of example, have direct electrical operation or also electro-pneumatic piloting. The aforementioned electrical pressure regulating signal ensures the electrical operation or activation of the control unit 15 and specifies the set point.

The supply input 16 is constantly connected via an internal inlet channel 11 of the compressed air maintenance unit 2 to the device inlet 6. The service output 17 is connected via an internal outlet channel 22 of the compressed air maintenance unit 2 to the device outlet 7, on which an outlet pressure P2 can be picked up, which at least then corresponds to the regulator output pressure, when the outlet channel 22 is open. So, when the working channel 22 is open the proportional pressure regulating valve 14 is able, as a function of the electrical pressure regulating signal applied to its electrical control input 21, to regulate outlet pressure P2 prevailing at the device outlet 7 at various levels of outlet pressure.

With the outlet channel 22 open, the proportional pressure regulating valve 14 brings about a constant compressed air connection between the compressed air source P and the consumer device A. In so doing, the consumer device A, independently of the instantaneous air flow, is provided with an outlet pressure P2 at a level regulated at a constant value.

The compressed air maintenance unit 2 also has an electrically controllable shut-off valve 8. This shut-off valve 8 is incorporated in the course of the outlet channel 22. It has a valve inlet 8*b*, which is connected via an inlet channel section 22*a* of the outlet channel 22 to the service output 17 of the proportional pressure regulating valve 14. It also has a valve outlet valve outlet 8*c*, which is connected via an output channel section 22*b* of the outlet channel 22 to the device outlet 7.

The shut-off valve 8 is preferably a switching valve. Alternatively, it can adopt at least two switching positions one of which is a release position shown in FIG. 1 and the other a shut-off position. In the release position, the shut-off valve 8 opens a fluid connection between the input channel section 22*a* and the output channel section 22*b*, enabling a passage of air through the outlet channel 22. In the shut-off position, the outlet channel 22 is shut off, so that no fluid transfer between the input channel section 22*a* and the output-channel section 22*b* is possible.

The respective switching position of the shut-off valve 8 is specifiable by means of an electrical valve control signal, suppliable to the shut-off valve 8 at an electrical control input 19. Expediently, the shut-off valve 8 has an electrically operable drive mechanism 9, which by means of the electrical valve control signal is electrically operable. The drive device 9 is, by way of example, of an electromagnetic type. The shut-off valve 8 is preferably a solenoid valve.

Expediently, the shut-off valve 8 is a 2/2-way valve. It is in particular of monostable design and preloaded by a spring 10 in a switching position functioning as starting position. This starting position exists in particular if no control signal is present on the electrical control input 19 of the shut-off valve 8. By applying the electrical valve control signal, a switching force can be generated, which overcomes the spring power of the spring 10 to switch the shut-off valve 8 to the second switching position and retains it in this second switching position until the electrical valve control signal has been removed again.

The shut-off valve is preferably of the "normally open" type, wherein the starting position specified by the spring 10 is the release position. If due to a fault, the electrical valve control signal is lost, this leads to the shut-off valve 8 adopting the release position and a compressed air supply to the consumer device A is guaranteed.

The shut-off valve 8 is expediently a component of a second valve module 8*a* of the modular compressed air maintenance unit 2. It is expediently detachably attached to the first valve module 14*a* equipping the proportional pressure regulating valve 14.

The compressed air maintenance unit 2 is equipped with sensor arrangement 20 for capturing multiple state variables of the compressed air contained in the system.

The sensor arrangement 20 contains a flow sensor 25, configured to measure the air flow Q of the compressed air flowing from the source P to the consumer device. It is irrelevant here at what point in the path of the channel the flow measurement takes place. As an example, the flow sensor 25 is connected to the inlet channel 11 but could similarly be connected to the outlet channel 22.

The sensor arrangement 20 also contains a pressure sensor connected to the outlet channel 22 connected and therefore referred to as an outlet pressure sensor 24, which captures the outlet pressure P2 prevailing in the output channel section 22*b* and thus also the outlet pressure P2 at the device outlet 7. The shut-off valve 8 is arranged in the outlet channel 22 between the proportional pressure control valve 14 and the outlet pressure sensor 24.

Expediently, the outlet pressure sensor 24 is a component of a first sensor module 24*a* of the compressed air maintenance unit 2 attached on the side facing away from the first valve module 14*a* to the second valve module 8*a*. Expediently, the device outlet 7 is located on the first sensor module 24*a*.

Expediently, the flow sensor 25 is a component of a second sensor module 25*a* of the compressed air maintenance unit 2. Expediently, the second sensor module 25*a* is attached on the side facing away from the valve module 8*a* to the first valve module 14*a*. Preferably, the device inlet 6 is located on the second sensor module 25*a*.

Optionally and preferably, the sensor arrangement 20 also contains a further pressure sensor connected to the inlet channel 11 connected and therefore referred to as an inlet pressure sensor 31. The inlet pressure sensor 31 is able to measure the air pressure prevailing in the inlet channel 11 and is consequently also referred to as inlet pressure.

The compressed air maintenance unit 2 contains an internal electronic control unit 26 preferably accommodated in the inside of the device housing 5, equipped with at least one microprocessor or microcontrol unit. For simplification, in the following it is referred to simply as "internal control unit 26". The internal control unit 26 is preferably a component of a control module 26*a* of the compressed air maintenance unit 2.

The internal control unit 26 takes care of the electrical actuation of the proportional pressure regulating valve 14 and of the shut-off valve 8 taking into consideration the measured values of the sensor arrangement 20 supplied to it.

The internal control unit 26 is connected via a signal path or electrically by internal electrical signalling lines 27 of the compressed air maintenance unit 2 to the electrical control input 21 of the proportional pressure regulating valve 14, with the electrical control input 19 of the shut-off valve 8, with the flow sensor 25, with the outlet pressure sensor 24 and with the optional inlet pressure sensor 31. The internal control unit 26 can receive electrical pressure measured values and flow measured values from the sensor arrangement 20 and can output an electrical pressure regulating signal to the proportional pressure regulating valve 14 and an electrical valve control signal to the shut-off valve 8. Preferably, the internal control unit 26 can also output electrical diagnostic signals which are discussed in more detail further on.

Reference to "an" electrical pressure regulating signal and "an" electrical valve control signal should be understood to mean in each case that a plurality of signals may also be involved.

The proportional pressure regulating valve 14 can be operated in two different operating modes, between which it is switchable. An operating mode is a working mode, which is set when the consumer device A is in operation and in which the outlet pressure P2 can be regulated at a specified and in particular variably specifiable working pressure value P2A, by way of example at 6 bar. This desired working pressure value P2A is stored as a reference value in the internal control unit 26 and can expediently be entered and/or varied from the outside application-specifically if required.

A further operating mode of the proportional pressure regulating valve 14 is a hold mode, in which the outlet pressure P2 can be regulated at a hold value P2H that is lower than the working pressure value P2A. This hold pressure value P2H is, by way of example, 3 bar. The desired hold pressure value P2H is also stored as a reference value in the internal control unit 26 and can expediently be entered and/or varied from the outside application-specifically if required.

The respective operating mode of the proportional pressure regulating valve 14 is specifiable by the electrical pressure regulating signal suppliable by the internal control unit 26.

Expediently, the compressed air maintenance unit 2 is equipped with an electrical interface, referred to in the following for a better understanding as a first communication interface 28, allowing communication via a signal path between the internal control unit 26 and an external electronic control device 23. The latter is expediently a component of the consumer control device 1 wherein, however, it is arranged away from the compressed air maintenance unit 2. The electronic control device 23 serves expediently for operational actuation of the consumer device A. To this end, a schematically indicated signal link 23*a* is present.

The first communication interface 28 is in particular arranged on an outside of the device housing 5 and expediently connected via internal electrical line 32 to the internal control unit 26. Preferably, the first communication interface 28 is of an electromechanical type and in particular designed as a plug-in interface or plug connection device, allowing a signal cable 33, shown schematically only, be detachably connected, creating a connection with the external electronic control device 23.

The first communication interface 28 is preferably a bus interface, able to transmit serial bus signals between the internal control unit 26 and the external electronic control device 23. Just like the internal electrical conductor 32, the external signal cable 33 can take the form of a serial bus system.

Alternatively, the first communication interface 28 can also be designed as a wirelessly-operating interface, in order in particular to allow communication via radio signals with the external electronic control device 23. The first communication interface 28 is expediently located on the control module 26*a*.

The internal control unit 26 preferably has electronic storage means 34, at least one comparator 35 and at least one output device 36. The storage 34 allows, by way of example, storage of pressure values relating to the outlet pressure measured by the outlet pressure sensor 24, and also flow values of the flow rates captured by the flow sensor 25 and possibly also pressure values relating to the inlet pressure measured by the inlet pressure sensor 31, as reference information and preferably also as actual information.

In the storage means 34, in particular a shutdown flow threshold AW, a threshold pressure value P2G and a hold pressure value P2H can be stored, which can be useful for an advantageous mode of operation of the consumer control device 1.

The comparator means 35 are able to compare stored reference information with in particular possibly intermediately-stored or also with directly measured actual information. The at least one output device 36 is able, as a function of the result of the comparison reached by the comparator 35 to output the pressure signal for the proportional pressure regulating valve 14 and the electrical valve control signal for the shut-off valve 8.

Preferably, the output means 36 are also able to output at least one electrical diagnostic signal for evaluation elsewhere.

The output of the electrical pressure control signal for the proportional pressure regulating valve 14 takes place during a normal operating phase of the consumer control device 1 on the basis of a comparison of the measured air flow Q with the shutdown flow threshold AW. Based on this comparison the proportional pressure regulating valve 14 is switched from working mode to hold mode.

This takes place automatically without external intervention by the electrical pressure regulating signal generated on the basis of the comparison result.

In an optional design variant of the consumer control device 1, a switch-on flow threshold EW can also be stored in the storage 34. On the basis of a comparison of the measured air flow with the stored switch-on flow threshold EW an electrical pressure control signal can be generated that switches the proportional pressure regulating valve 14 from the hold mode back into the working mode.

Preferably, the output device 36 of the internal control unit 26 also outputs an electrical diagnostic signal to the first communication interface 28, from where it can be transmitted for further processing as necessary to the external electronic control unit 23.

At least one electrical diagnostic signal can also be passed to at least one optionally present optical display 37 of the compressed air maintenance unit 2, for visualisation in an optional manner.

The compressed air maintenance unit 2 can also be equipped with at least one acoustic alerter 38 indicated solely by a dashed line, by way of example a buzzer, so that upon receipt of a corresponding electrical signal in situ an acoustic warning signal can be output.

During its operation, the internal control unit 26 can receive and process measurement signals originating from its sensor arrangement 20 as actual information. In this way, the internal control unit 26 receives time-dependent current values of the air flow Q and the outlet pressure P2 and possibly also of the inlet pressure as actual information. The internal control unit 26 can be configured to output this actual information to the first communication interface 28 and/or to the optical display means 37 electrically or visually.

Expediently, the internal control unit 26 when the consumer control device 1 is in operation, is able to generate from a comparison between measured actual information and stored reference information at least one electrical diagnostic signal, providing an indication of the energy situation of the connected consumer device A.

By way of example, for monitoring of the flow Q a once-only or multiple logging of actual information on the air flow Q can take place, wherein a multiple logging of actual information in particular can take place at regular intervals of time.

In the following, using the diagram of FIG. 2, a preferred process sequence for controlling the compressed air supply of the consumer device A using the exemplary consumer control device, is explained. The diagram has three sections shown one on top of the other, wherein the uppermost section illustrates the course of the outlet pressure P2 over the time t, the bottom section the air flow Q over the time t and the middle section the switching position VA of the shut-off valve 8 over the time t.

The process sequence shown begins with a normal operating phase NBP of the consumer control device 1. During this normal operating phase NBP, the proportional pressure regulating valve is in the working mode AM and the shut-off valve 8 in the release position V1. Accordingly, compressed air flows with a certain air flow Q, which may indeed vary, through the compressed air maintenance unit 2 to the external consumer device A having a corresponding air consumption. The outlet pressure P2 of the compressed air supplied to the consumer device A corresponds to the set working pressure value P2A regulated by the proportional pressure regulating valve 14.

At least during the normal operating phase NBP, the air flow Q is continually measured by the flow sensor 25 and transmitted as actual information to the internal control unit 26. There, a constant comparison takes place with the stored shutdown flow threshold AW. If the flow sensor 25, detects a reduced flow value corresponding to the shutdown flow threshold or below this, for a specified, in particular externally specifiable, time tG, the interpretation of this is that there is no longer an operationally-relevant air consumption at the consumer device A. Thus, the internal control unit 26 generates a valve control signal supplied to the shut-off valve 8, which switches the shut-off valve 8 from the release position V1 to the shut-off position V0. So begins a stand-by mode phase SBP of the consumer control device 1, in which the output channel section 22*b* of the outlet channel 22 is isolated from the pressure source P and the compressed air in the channel system between the shut-off valve 8 and the consumer device A is confined. In this way, energy is saved during an operational pause by the consumer device A.

Whilst during this stand-by mode phase SBP the shut-off valve 8 adopts the shut-off position V0, the pressure setting of the proportional pressure regulating valve 14 is in principle irrelevant. However, whilst the outlet pressure P2 captured by the outlet pressure sensor 24 is above the threshold pressure value P2G, it is advantageous to leave the proportional pressure regulating valve 14 in working mode AM.

In particular depending on the quality of the channel network connecting to the shut-off valve 8 and the presence or absence of further active small consumers of the consumer device A, during the stand-by mode phase SBP either no, or a greater or lesser, drop in pressure takes place in the output channel section 22*b* shut off from the device inlet 6. In particular, the degree to which the pressure drops is also influenced by the time the air is shut off by the shut-off valve 8.

Figure 2:
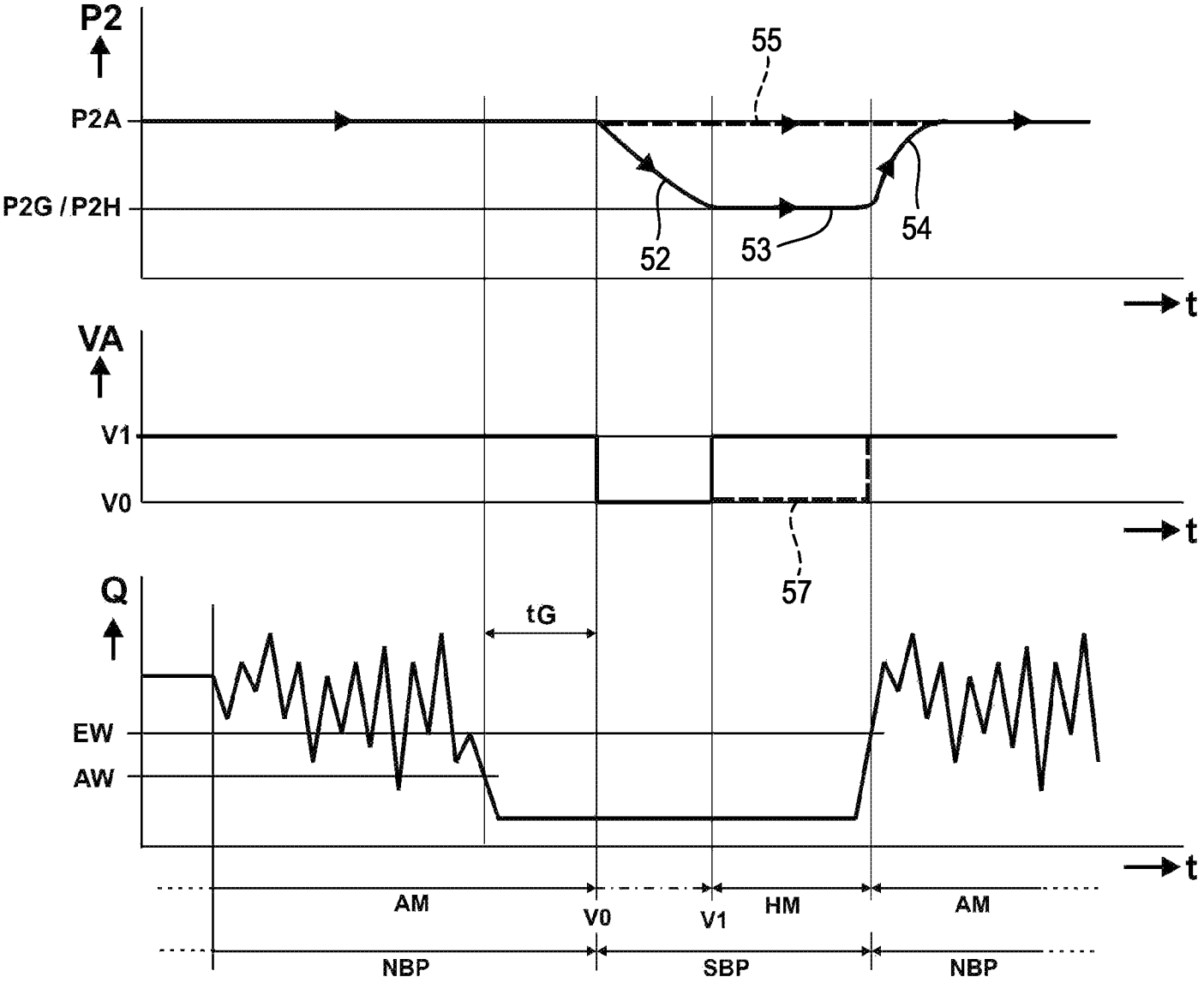

If the outlet pressure P2 drops during the stand-by mode phase SBP to the specified threshold pressure value P2G, visualised in the top section of the diagram of FIG. 2 by a falling section of the characteristic curve 52, the shut-off valve 8 is switched back by the internal control unit 26 to the release position V1. As an example, this takes place by removing the hitherto applied electrical valve control signal due to the greater power of the spring 10. The outlet channel 22 is then free again for compressed air to flow through it.

In connection with the switching of the shut-off valve 8 from the shut-off position V0 back to the release position V1, the proportional pressure regulating valve 14 is shifted by the internal control unit 26 from the working mode AM to the hold mode HM. If the internal control unit 26 is programmed so that at the end of the normal operating phase NBP it already places the proportional pressure regulating valve 14 in the hold mode, the corresponding switching upon reaching the threshold pressure value P2G is dispensed with.

Therefore, the next section of the stand-by mode phase SBP in any case takes place with the shut-off valve 8 in the release position V1 and with the proportional pressure regulating valve 14 in hold mode HM. This prevents the supply line to the consumer device A or the consumer device A itself being unpressurised. A minimum air pressure is always created, corresponding to the holding pressure value P2H specified by the proportional pressure regulating valve 14. In the top section of the diagram of FIG. 2, this is visualised by a horizontal characteristic curve section 53. Therefore, adverse effects on or damage to the consumer device A due to inadequate pressurisation can be avoided. Compared to a state in which the outlet pressure P2 would be held at the working pressure value P2A, a considerable energy saving is achieved.

Preferably, the hold pressure value P2H provided by the proportional pressure regulating valve 14 during the hold mode corresponds to the threshold pressure value P2G bringing about the switching of the shut-off valve 8 from the release position V1 to the shut-off position V0. However, different pressure settings can also be carried out.

If on the consumer device A side, the normal compressed air consumption again prevails, by way of example because the consumer device A following an operational pause is put back into operation, the internal control unit 26 switches the consumer control device 1 from stand-by mode phase SBP back to the normal operating phase NBP. This means that the shut-off valve 8 continues to be held in the release position V1, but the proportional pressure regulating valve 14 is switched from the hold mode HM back to the working mode AM. So, the consumer device A is again supplied with compressed air, the outlet pressure P2 of which corresponds to the regulated working pressure value P2A. The initial increase in pressure taking place upon switching from the hold mode HM to the working mode AM is visualised in the top section of the diagram of FIG. 2 by a rising characteristic curve section 54.

The switching from the stand-by mode phase SBP to the normal operating phase NBP is, by way of example, brought about by a corresponding electrical switchover signal, which the external electronic control unit 23, on the basis of the operational situation of the consumer device A connected to it, transmits via the first communication interface 28 to the internal control unit 26. The consumer control device 1 can also be designed for manual input of the corresponding switchover signal.

In addition, or alternatively, the consumer control device 1 can also be designed such that in the event of an increased air requirement on the connected external consumer device A side, a purely flow-dependent switching from the stand-by mode phase SBP to the normal operating phase NBP is initiated. To this end, during the stand-by mode phase SBP a constant comparison of the air flow Q measured by the flow sensor 25 with the switch-on flow threshold EW stored as the reference value takes place. If the measured air flow Q increases to the switch-on flow threshold EW, the interpretation of this is that the consumer device A has started again in normal mode, so that the internal control unit 26 automatically and without an external switchover signal brings about the switching from the stand-by mode phase SBP to the normal operating phase NBP. This mode of operation is illustrated in the diagram of FIG. 2.

In the top section of FIG. 2, a dashed horizontal characteristic curve section 55 illustrates a mode of operation that takes place if during the stand-by mode phase no drop in pressure takes place on the outlet pressure P2 side. The internal control unit 26 then has no reason to already switch the shut-off valve 8 during the stand-by mode phase SBP to the release position V1. The latter then takes place according to the characteristic curve section 57 shown as a dashed line in the middle section of the diagram of FIG. 2 only if the consumer control device 1 is again switched to the normal operating phase NBP.

With such an operating sequence, it is advantageous if the proportional pressure regulating valve 14 always remains in working mode AM, so that upon transition from stand-by mode phase SBP to normal operating phase NBP no upward regulation of the outlet pressure P2 is necessary.

Preferably, the time limit tG, which specifies a delay in switching between the normal operating phase NBP and the stand-by mode phase SBP, is specifiable from the outside. In this way, the switching sensitivity can also be set as required.

The compressed air maintenance unit 2 is preferably equipped with one or more input devices 42, allowing an activation and/or influencing and/or parameterisation of the operational behaviour of the internal electronic control unit 26 and preferably also of the sensor arrangement 20.

The input devices 42 are, by way of example, configured in the form of an arrangement of keys and/or switches 42*a* and/or for electronic input. For electronic input, in the exemplary embodiment, the electrical interface formed by the first communication interface 28 can be used, which here is a bus interface, wherein the external electronic control unit 23 can be used as an information input device. The bus interface can, by way of example, correspond to the I/O link standard.

As an example, the compressed air maintenance unit 2 is equipped with a further, second communication interface 29, that can be used as a diagnostics interface and can at least temporarily be connected to the by way of example one electronic information readout device 46 of the consumer control device 1. Such an information readout device 46 allows, by way of example, the reading out of measured actual information, in particular in connection with the associated reference data. The second communication interface 29 is, by way of example an Ethernet interface or other digital output. It is located in particular on the preferably present control module 26*a*.

As a further input device 42, for electronic data input for the purpose of configuration of the system, the compressed air maintenance unit 2 as an example contains a third communication interface 30, to which expediently an operating unit and/or a personal computer (PC) or other data input device 47 can be connected. The at least one third communication interface 30 is preferably an Ethernet interface or other digital input. Preferably, the third communication interface 30 is located on a communication module 30*a* of the compressed air maintenance unit 2.

Preferably, the compressed air maintenance unit 2 is also equipped with a communication interface which, for a clearer distinction, is referred to as a fourth communication interface 39, serving for communication between the internal control unit 26 and one or more further independent compressed air maintenance units, which is or are not further depicted. As an example, the fourth communication interface 39 is similarly a component of the communication module 30*a*.

Needless to say, the compressed air maintenance unit 2 can be equipped with optional further electrical interfaces for input and/or output of data and/or electrical signals.

The preferred consumer control device 1 illustrated by way of example, allows, inter alia with the help of the input means 42, an external input of the outlet pressure P2, which is intended to be regulated by the proportional pressure regulating valve 14. The compressed air maintenance unit 2 communicates with the external electronic control device 23 and consequently can immediately implement a changed pressure value.

Preferably, the consumer control device 1 integrates a soft start function, not further illustrated, to avoid abrupt pressure increases. The user can define the speed at which it is intended to fill the connected consumer device A, by independently inputting suitable parameters.

What is claimed is:

1. A consumer control device, with a compressed air maintenance unit comprising:

an electrically controllable proportional pressure regulating valve, having a supply input and a service output;

a device inlet, connectable or connected to an external compressed air source, connected via an inlet channel to the supply input of the proportional pressure regulating valve;

a device outlet connectable or connected to an external consumer device, connected via an outlet channel to the service output of the proportional pressure regulating valve;

a sensor arrangement at least including one or both of a flow sensor for measuring air flow occurring in the inlet channel or in the outlet channel and an outlet pressure sensor for measuring the outlet pressure prevailing in the outlet channel; and an internal electronic control unit connected via a signal path to the proportional pressure regulating valve and to the sensor arrangement, configured to generate an electrical pressure regulating signal for the proportional pressure regulating valve, as a function of state values of the compressed air measured by the sensor arrangement, wherein the proportional pressure regulating valve can regulate the outlet pressure prevailing in the outlet channel at various levels as a function of the electrical pressure regulating signal applied to it, wherein it is operable both in a working mode regulating the outlet pressure to a working pressure value and a hold mode regulating the outlet pressure to a hold pressure that is lower than the working pressure value, wherein in the outlet channel between the proportional pressure regulating valve and the outlet pressure sensor, an electrically controllable shut-off valve connected via a signal path to the internal electronic control unit, is provided, which through an electrical valve control signal from the internal electronic control unit can selectively be switched to a release position opening the outlet channel for an air flow or a shut-off position shutting off the outlet channel, wherein the internal electronic control unit is configured such that during the working mode of the proportional pressure regulating valve it can automatically switch over the shut-off valve from the release position to the shut-off position, if the flow sensor within a specified or specifiable time limit detects an air flow corresponding to or below a specified or specifiable shutdown flow threshold value, and wherein the internal electronic control unit is also configured such that it also automatically can switch the shut-off valve from the shut-off position back into the release position and place the proportional pressure regulating valve in the hold mode, if the outlet pressure sensor whilst the shut-off valve is in the shut-off position detects an outlet pressure that is lower than the working pressure and corresponds to a specified or specifiable threshold pressure value.

2. The consumer control device according to claim 1, wherein the shut-off valve is configured as a 2/2-way valve of the "normally open" type and preloaded by a spring in the release position.

3. The consumer control device according to claim 1, wherein the internal electronic control unit is configured such that if on the connected external consumer device side increased air demand again occurs, the internal electronic control unit is able to cause shifting the proportional pressure regulating valve from the hold mode to the working mode while the shut-off valve remains unchanged in the release position.

4. The consumer control device according to claim 1, wherein the outlet pressure sensor is separate from the proportional pressure regulating valve or is integrated into the proportional pressure regulating valve.

5. The consumer control device according to claim 1, wherein the sensor arrangement has an inlet pressure sensor serving for measurement of the inlet pressure prevailing in the inlet channel, the inlet pressure sensor being connected to the internal electronic control unit via a signal path.

6. The consumer control device according to claim 1, wherein the internal electronic control unit has at least one output device, able to output the electrical pressure regulating signal intended for the proportional pressure regulating valve and the electrical valve control signal intended for the shut-off valve and at least one electrical diagnostic signal generated with assistance of the sensor arrangement.

7. The consumer control device according to claim 6, wherein the compressed air maintenance unit has at least one communication interface for picking up the generated electrical diagnostic signal.

8. The consumer control device according to claim 6, wherein the compressed air maintenance unit is equipped with one or both of at least one optical display and an acoustic alerter, which are able to be activated on the basis of electrical diagnostic signals.

9. The consumer control device according to claim 1, wherein the internal electronic control unit has a comparator, in which actual information supplied by the sensor arrangement are compared with reference information stored in the internal electronic control unit and which provides a comparison result, wherein the internal electronic control unit also has at least one output device configured for outputting the electrical pressure regulating signal for the proportional pressure regulating valve and the electrical valve control signal for the shut-off valve as a function of the comparison result of the comparator.

10. The consumer control device according to claim 1, wherein the internal electronic control unit has a memory for the volatile or remanent storage of various data, namely data of a group comprising measurement data, control data, diagnostics data and analysis data.

11. The consumer control device according to claim 1, wherein the compressed air maintenance unit is configured in the form of a unit with a modular structure, wherein the proportional pressure regulating valve is a component of a first valve module, the shut-off valve is a component of a second valve module, the outlet pressure sensor is a component of a first sensor module and the internal electronic control unit is a component of a control module.

12. The consumer control device according to claim 11, wherein, the compressed air maintenance unit also in addition has at least one communication module equipped with at least one communication interface connected to the internal electronic control unit.

13. The consumer control device according to claim 1, wherein the compressed air maintenance unit has at least one communication interface connected to the internal electronic control unit, to which, for communication with the internal electronic control unit, an internal or external electronic device can be connected.

14. The consumer control device according to claim 13, wherein the external electronic device is any device of a group consisting of an external electronic control unit, an electronic information readout device and an electronic data input device.

15. The consumer control device according to claim 13, wherein at least one communication interface is designed as a bus interface.

16. The consumer control device according to claim 13, wherein at least one communication interface is designed as a digital or analogue input or as a digital or analogue output, wherein at least one communication interface is configured as an electromechanical plug-in interface or for wireless signal transmission.

17. The consumer control device according to claim 1, wherein the compressed air maintenance unit is equipped with at least one input device for activating or influencing or parameterising the operational behaviour of the internal electronic control unit or of the sensor arrangement, wherein the at least one input device comprises at least one key or at least one switch or at least one electrical communication interface.

18. The consumer control device according to any claim 1, wherein it comprises an external electronic control unit which is connected or connectable in terms of control to the internal electronic control unit of the compressed air maintenance unit.

19. A method for controlling the compressed air supply of a consumer device by means of a consumer control device, wherein the method comprises:

supplying the consumer device with compressed air under an outlet pressure via an electrically controllable proportional pressure regulating valve and via an electrically controllable shut-off valve which is connected downstream and in series to the proportional pressure regulating valve;

measuring an air flow flowing through the proportional pressure regulating valve and through the shut-off valve to the consumer device; and measuring an outlet pressure of the compressed air, which is supplied to the consumer device, downstream of the shut-off valve, wherein, during a normal operating phase of the consumer control device, in which the measured air flow is above a specified shutdown flow threshold, the proportional pressure regulating valve is operated in a working mode and the shut-off valve is operated in a release position enabling the passage of air to the consumer device, wherein the proportional pressure regulating valve during the working mode outputs compressed air to the shut-off valve regulated at a specified working pressure value, and wherein, during the normal operating phase, the shut-off valve is switched from the release position to a shut-off position preventing a passage of air, if the measured air flow within a specified time limit is not higher than a specified shutdown flow threshold, as a result of which from then on the consumer control device is operated in a stand-by mode phase, and wherein, during the stand-by mode phase, the shut-off valve is switched back to the release position and the proportional pressure regulating valve is operated in a hold mode, if the measured outlet pressure during the shut-off position of the shut-off valve drops to a specified threshold pressure value, which is lower than the working pressure value, wherein the proportional pressure regulating valve during the hold mode outputs compressed air to the shut-off valve at a regulated hold pressure value that is lower than the working pressure value.

20. The method according to claim 19, wherein the level of the hold pressure value of the outlet pressure corresponds to the threshold pressure value.

21. The method according to claim 19, wherein, if there is an increase in air demand on the connected external consumer device side, the proportional pressure regulating valve is shifted from the hold mode to the working mode again while leaving the working valve in the release position.

* * * * *